US005238418A

United States Patent [19]

Koiner

[11] Patent Number: 5,238,418

[45] Date of Patent: Aug. 24, 1993

[54] MULTIPOLAR ELECTRIC COUPLING DEVICE

[75] Inventor: Josef Koiner, Pommelsbrunn, Fed. Rep. of Germany

[73] Assignee: TRW Daut & Rietz GmbH & Co. KG, Nuremberg, Fed. Rep. of Germany

[21] Appl. No.: 838,420

[22] PCT Filed: Jul. 4, 1991

[86] PCT No.: PCT/EP91/01248

§ 371 Date: Mar. 5, 1992

§ 102(e) Date: Mar. 5, 1992

[87] PCT Pub. No.: WO92/02058

PCT Pub. Date: Feb. 6, 1992

[30] Foreign Application Priority Data

Jul. 17, 1990 [DE] Fed. Rep. of Germany ..... 4022701

[51] Int. Cl.[5] ..... H01R 13/00

[52] U.S. Cl. ..... 439/157

[58] Field of Search ..... 439/152-160

[56] References Cited

U.S. PATENT DOCUMENTS 3,054,023 9/1962 Blecker et al. ..... 439/160

3,778,747 12/1973 Curcic ..... 439/157

4,586,766 5/1986 Hofmeister ..... 439/160

FOREIGN PATENT DOCUMENTS 8711672 9/1988 Fed. Rep. of Germany .

2424643 11/1979 France .

*Primary Examiner*—Joseph H. McGlynn

*Attorney, Agent, or Firm*—Collard & Roe

[57] ABSTRACT

A multiterminal electric coupling device having a longitudinally-extending plug element including a plug housing with grooves on one end thereof and plug contacts contained within the plug housing. A longitudinally-extending socket element is provided and includes a socket housing with longitudinally-extending grooves and socket contacts contained within the socket housing. A hook-pin hinge is provided at one end of the housings for flexibly connecting the housings together. A longitudinally-extending slider is provided and has an interior and exterior sides and longitudinally-extending interior facing strips. The strips are locatable in the socket housing grooves at an end remote from the hook-pin hinge to allow for guided movement of the slider in the longitudinal direction with respect to the socket element. The slider includes blocks rigidly connected to the exterior sides so that when said block slide along the plug housing grooves said slider moves longitudinally along said socket housing and said housings pivot about said hook-pin hinge whereby said plug housing is joined to said socket housing and said plug contacts are electrically coupled to said socket contacts.

9 Claims, 5 Drawing Sheets

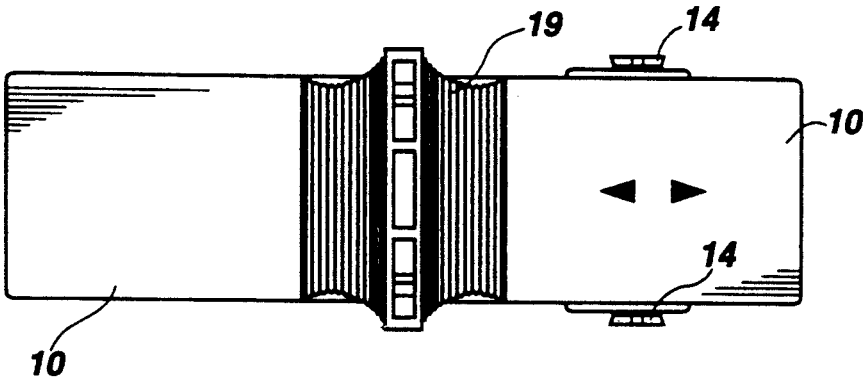
Fig. 14
Fig. 15
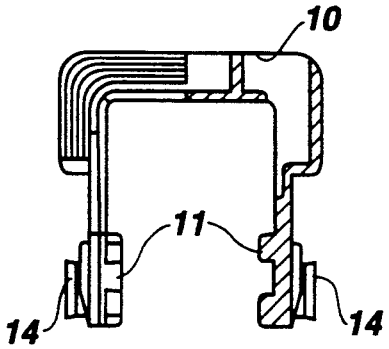
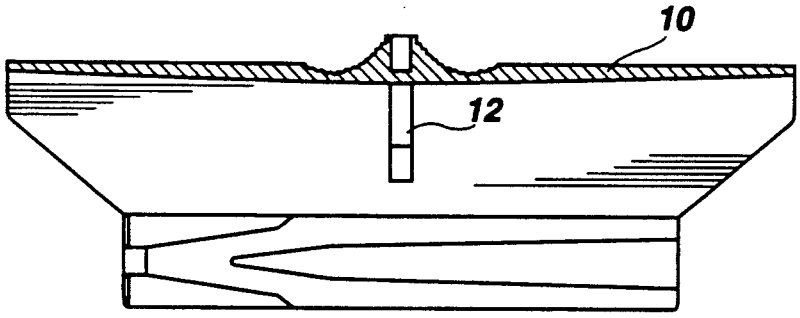
Fig. 16
Fig. 17
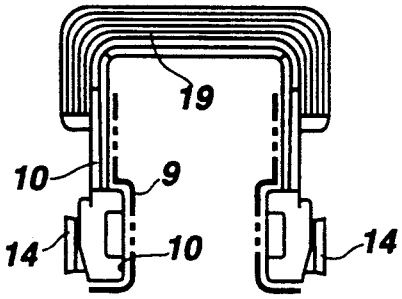

MULTIPOLAR ELECTRIC COUPLING DEVICE

BACKGROUND OF THE INVENTION

1. Field of the Invention

The invention relates to a multipolar electric coupling device with a multipoint plug and a socket board each housed in a housing. The socket board housing and the multipoint plug housing are connected to each other by means of a detachable hinge located on one end of the housings. The housings are pressed together by means of pins of the socket board housing guided in connecting grooves of the multipoint plug housing, in order to produce contact between the multipoint plug housing and the socket board housing.

2. Prior Art

The prior art discloses a plug device (DE 34 07 725 A1) for an electrical switching apparatus. The plug is attached to the switching apparatus hooking it onto a holder part of the switching apparatus with a hook, and pressing the two parts together for coupling. A stirrup is attached to the plug by a hinge, and can be pivoted into slits of the holder part. The stirrup, which acts like a toggle joint, exerts disruptive forces on the plug in the region of its attachment, and requires a large pivot range which often causes difficulties in installation.

In another known plug device (U.S. Pat. No. 3,668,605), the plug, which is attached to the holder part by a hinge at one end, can be pressed against the holder part by means of a double lever attached to pivot on the plug. In this plug device, the lever also results in mechanical stress on the plug and requires a lot of room, because of the pivot range.

SUMMARY OF THE INVENTION

It is the task of the invention to create a coupling device of the above type, in which the socket board housing is free of stress-intensive lever joints, and reliable coupling is possible within a small space.

According to the invention, this task is accomplished by a socket board housing which pivots on the multipoint plug housing by means of a hinge formed by pins that penetrate into groove-like recesses in the multipoint plug housing. A slider is guided to move longitudinally on the socket board housing. The slider carries sliding locks rigidly attached at both sides, at the end facing away from the hinge. Connecting grooves are arranged in both longitudinal walls of the multipoint plug housing, the sliding blocks can be pushed into or pulled out of the grooves to press the socket board housing on or to release it from the slider. In the coupling device, all that is required to make contact between the multipoint plug and the socket board are simple, space-saving movements of the slide, when the socket board housing is attached by a hinge. With the interaction of the sliding blocks and the connecting grooves, the socket board housing is placed and pressed against the multipoint plug housing by applying a slight force in one direction of movement of the slider. The socket board housing is lifted off from the multipoint plug housing by moving the slider in the other direction. As a result, pivoting levers and the pivot areas for them are no longer required.

In a development of the coupling device, the connecting grooves are widened close to the ends facing away from the introduction ends for the sliding blocks, as catch recesses for the sliding blocks. The sliding blocks in the widenings can be fixed in place elastically in the catch recesses, by the preload of a sealing element arranged in the separation plane of the socket board housing and the multipoint plug housing. Unintentional uncoupling can therefore be prevented.

According to the preferred embodiment, the slider is structured to be hood-shaped, with an essentially U-shaped cross section perpendicular to the direction of movement. In addition, the slider has guide strips on the inside of the shanks, which engage to move in longitudinal grooves of the socket board housing. In a practical embodiment, the slider can be pushed onto the socket board housing from both sides which proves to be advantageous for optionally passing the electrical leads connected with the sockets to one side or the other.

According to another embodiment of the coupling device, the slider and the socket board housing are fixed in place against each other so as to be releasable by catch elements. It is practical to lock the slider in the position in which the sliding blocks are opposite the introduction openings of the connecting grooves.

Finally, it is also provided that the multipoint plug housing has a web or something similar which extends between the multipoint plug longitudinal walls, with a number of coding slits arranged next to one another. The socket board housing is provided with coding projections which correspond to the coding slits. The web which has the coding slits can be arranged at the end of the multipoint plug housing which faces the connecting grooves. The coding, i.e., arrangement of the slits provided brings the additional advantage that in case of non-matching coding, movement of the slider on the socket board housing is impossible, and thus the user is informed, in advance that a coupling of the socket board and the multipoint plug cannot be carried out.

It is understood that the housings for the socket board and the multipoint plug can each be made from any suitable material, e.g., a plastic or metallic material.

BRIEF DESCRIPTION OF THE DRAWINGS

The invention is explained on the basis of an embodiment in the drawings, wherein:

FIG. 14 is a top view of the slider;

FIG. 15 is a side view, in partial cross section, of the slider;

FIG. 16 is a longitudinal cross-sectional view of a slider according to FIG. 13;

FIG. 17 is a side view of the slider;

DETAILED DESCRIPTION OF THE PREFERRED EMBODIMENT

Figure 1:
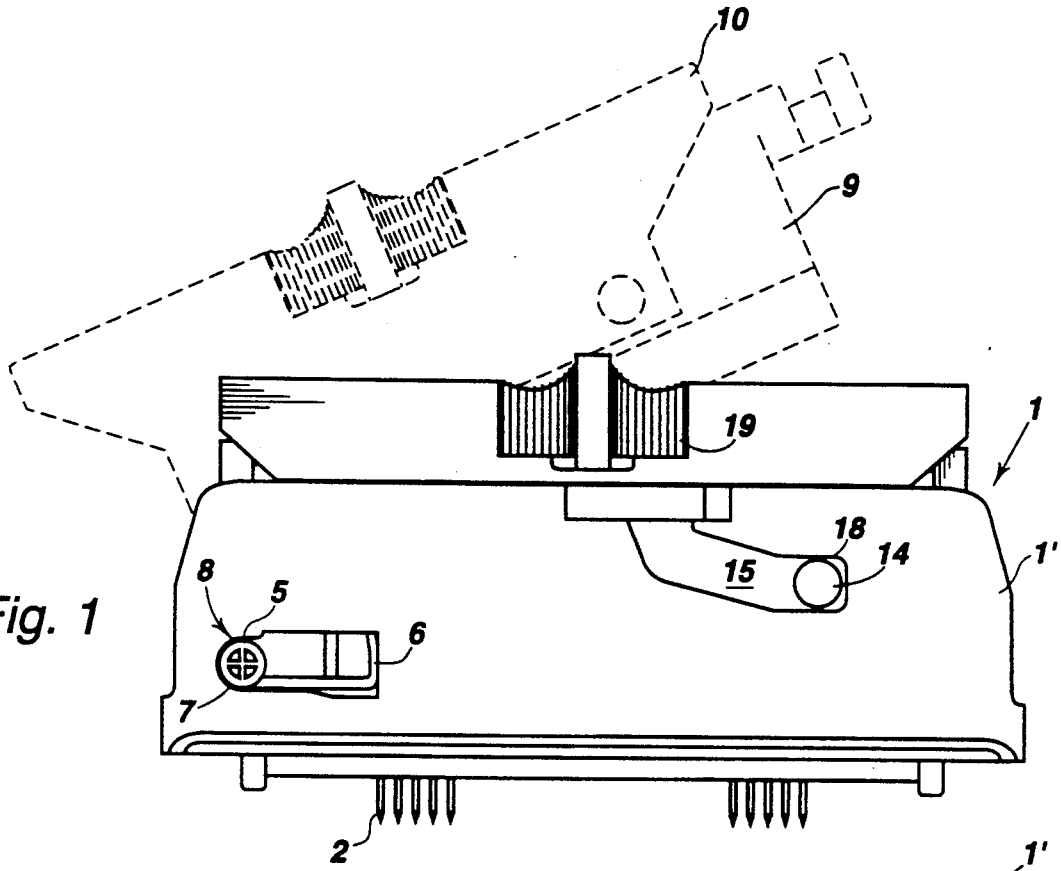
FIG. 1 is a side view of a coupling device according to the invention.
Figure 2:
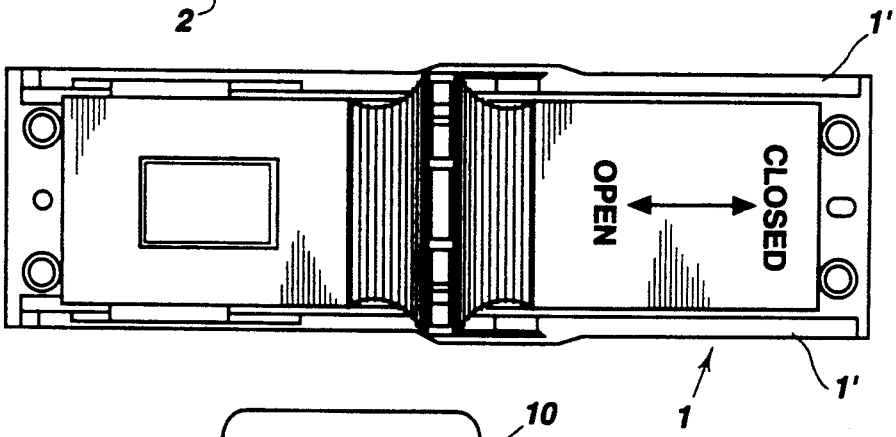
FIG. 2 is a top view of the coupling device.
Figure 3:
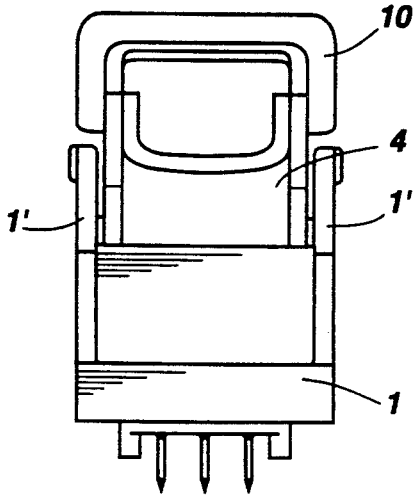
FIG. 3 is a side view of the coupling device.
Figure 4:
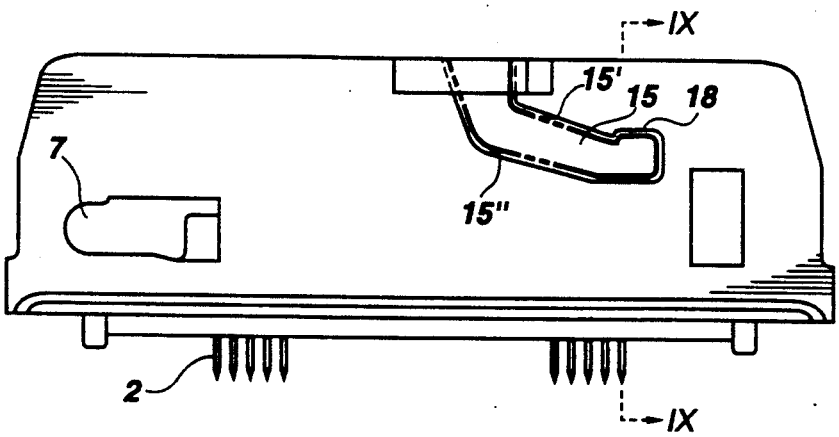
FIG. 4 is a side view of a multipoint plug housing.
Figure 5:
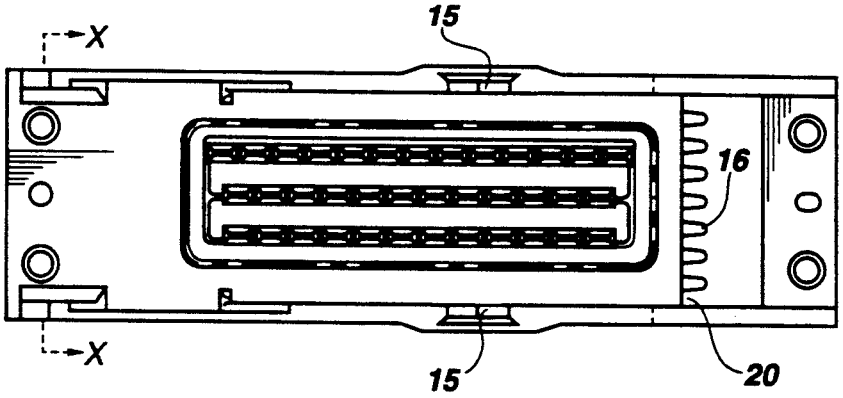
FIG. 5 is a top view of the multipoint plug housing according to FIG. 4.
Figure 6:
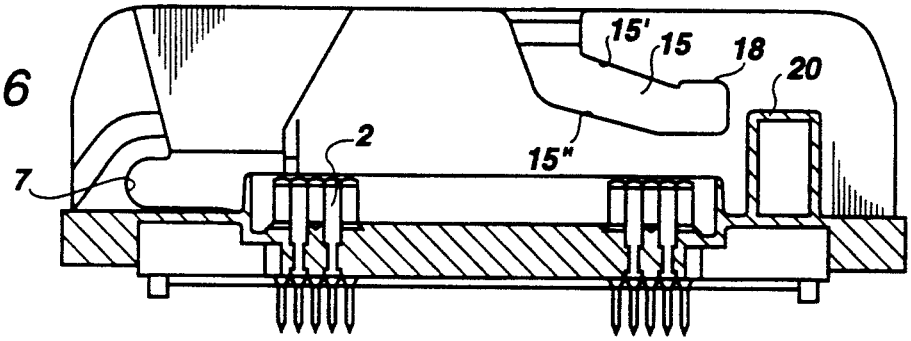
FIG. 6 is a cross-sectional view of the multipoint plug housing according to FIG. 4.
Figure 7:
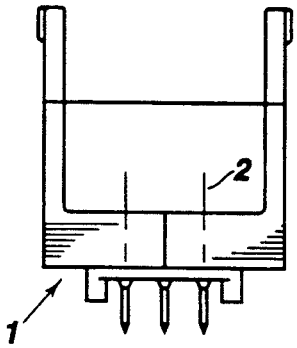
FIG. 7 is a side view of the multipoint plug housing according to FIG. 4.
Figure 8:
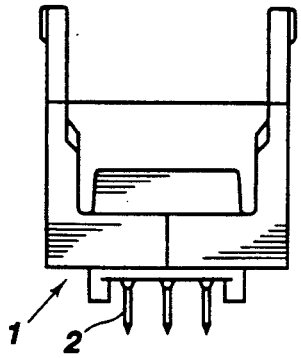
FIG. 8 is another side view of the multipoint plug housing according to FIG. 4.
Figure 9:
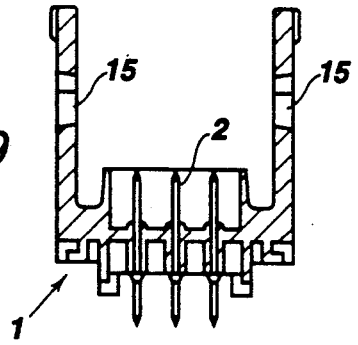
FIG. 9 is a cross-sectional view taken along the line IX—IX from FIG. 5.
Figure 10:
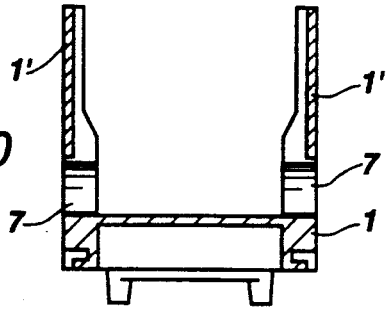
FIG. 10 is a cross-sectional view taken along the line X—X from FIG. 5.
Figure 11:
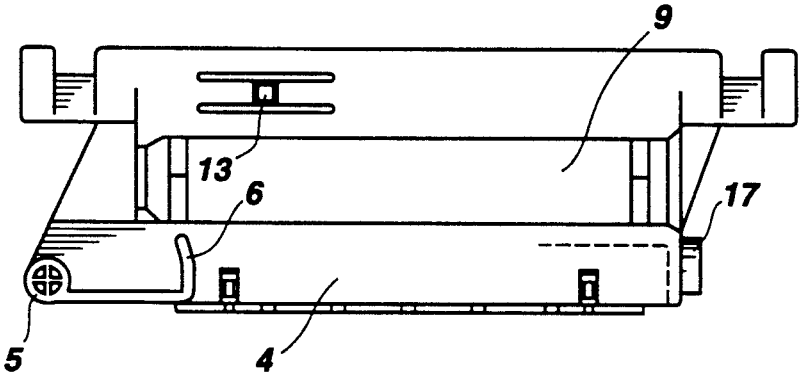
FIG. 11 is a side view of a socket board housing.
Figure 12:
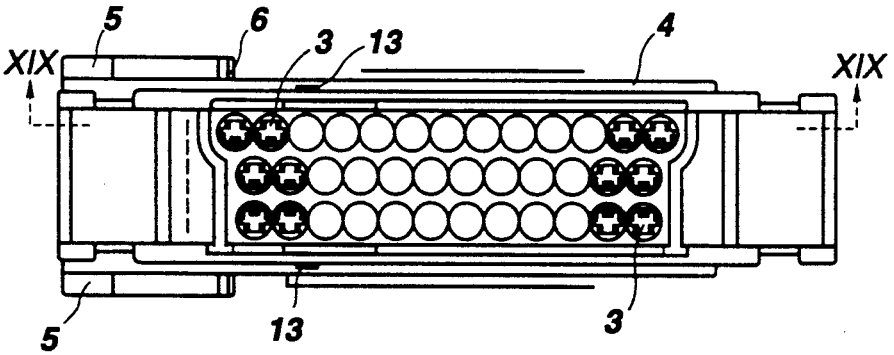
FIG. 12 is a top view of the socket board housing.
Figure 13:
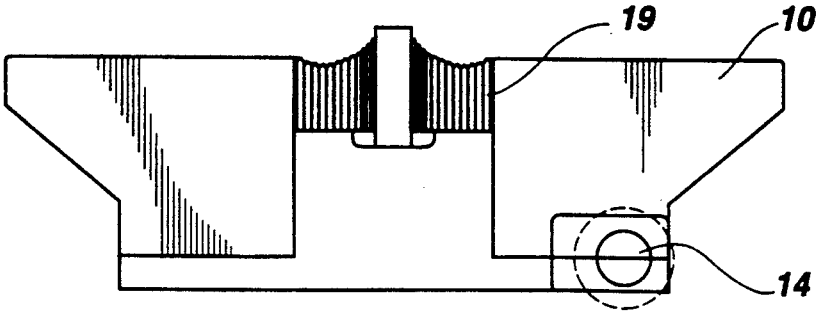
FIG. 13 is a side view of a slider.
Figure 18:
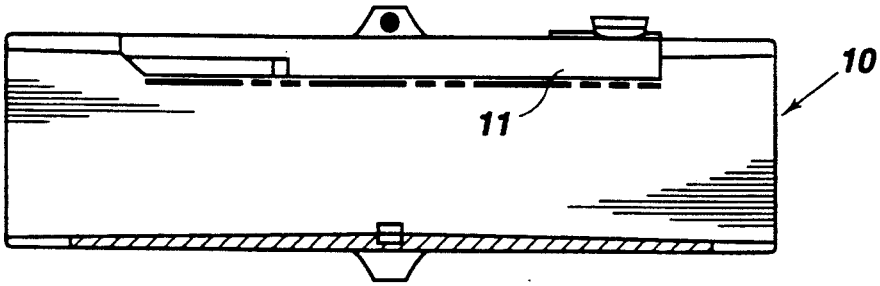
FIG. 18 is a bottom view of the slider according to FIG. 13, in partial cross section.
Figure 19:
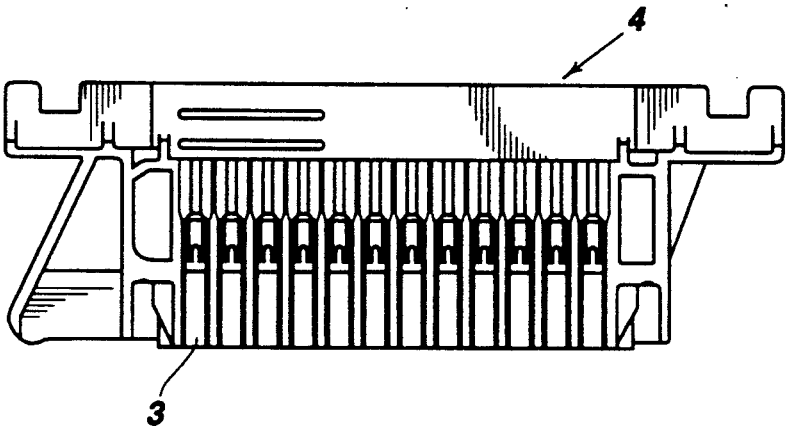
FIG. 19 is a cross-sectional view of a socket board housing taken along line XIX—XIX from FIG. 12.
Figure 20:
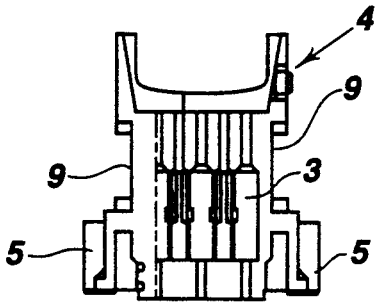
FIG. 20 is a front side elevational view of a socket board housing.

In FIG. 1, a multipoint plug housing 1 holds a number of multipoint contacts 2, as is evident in FIGS. 5, 6 and 9. A number, e.g., 37 socket contacts 3 (FIG. 12, 19, 20) which are housed in a socket board housing 4 (FIG. 11) can be coupled with the multipoint contacts 2. Multipoint plug housing 1 and socket board housing 4 are preferably formed from molded plastic. Socket board housing 4 has pins 5 with pressure strips 6. Pins 5 extend outwardly on both sides of a front end of housing 4 and penetrate into recesses 7 of the multipoint plug housing 1 to form a common hinge 8. With hinge 8, socket board housing 4 is held on the multipoint plug housing 1 so that it can pivot away. Pressure strips 6 support the introduction and holding of pins 5 in recesses 7. Socket board housing 4 also has longitudinal grooves 9, into which a slider 10 having strip-shaped projections 11 engages. Slider 10 can be moved longitudinally on socket board housing 4. Slider 10 can be locked in place on catch projections 13 (FIG. 11) of socket board housing 4, by means of catch grooves 12 (FIG. 16).

Slider 10 (FIG. 15, 17) is formed from a molded part with an essentially U-shaped cross section, and is provided with gripping surfaces 19 on the outside top. Pins 14 are arranged on the slider 10 as sliding blocks, which are inserted into connecting grooves 15 in the side walls 1' of multipoint plug housing 1. Furthermore, multipoint plug housing 1 has a web 20, i.e., a wall segment between the side walls 1', which is provided with a number of coding slits 16. Projections 17 arranged on the socket board housing 4 interact with the coding slits 16 for coding purposes.

Figure 21:
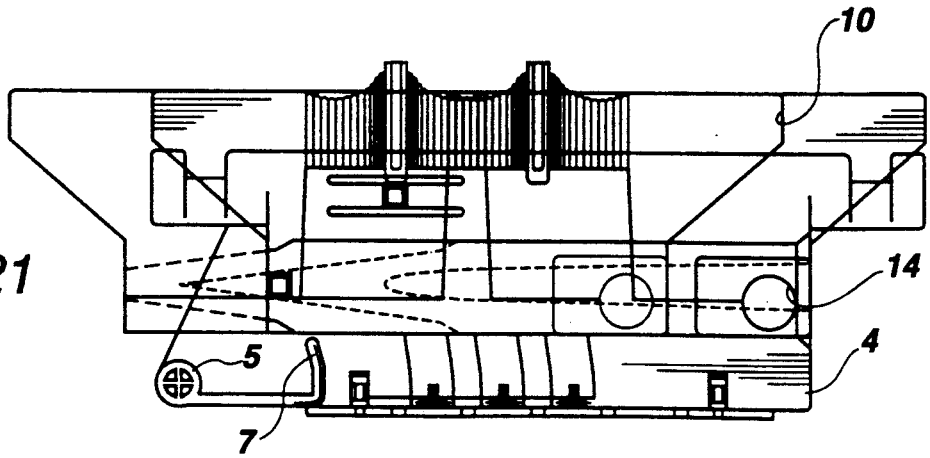
FIG. 21 is a side view of the socket board housing with a slider located in different positions.

The longitudinal mobility of slider 10 on socket board housing 4 allows different setting movements on socket board housing 4 (FIG. 21), which has an advantageous effect for contacting the socket contacts with electrical leads (not shown). The electrical leads can extend through either side of the socket board housing 4.

To understand the function of the coupling device, it must be assumed that after attachment of the electrical leads (not shown) to socket contacts 3, slider 10 can be pushed onto socket board housing 4 from the one frontal side (FIG. 21) Afterwards, socket board housing 4 with slider 10 can be connected with multipoint plug housing 1 by a hinge, by inserting pins 5 into recesses 7 (FIG. 1). Socket board housing 4 can be pivoted, as further shown in FIG. 1, in the direction of the coupling position of socket contacts 3 and multipoint contacts 2.

In this connection, socket board housing 4 first takes the upper position of FIG. 1, shown with broken lines, and subsequently takes the contact position (inner final position of the socket board housing) by being pressed against the multipoint plug housing with sliding blocks 14 entering connecting grooves 15. Sliding blocks 14 enter due to the longitudinal movement of slider 10 on socket board housing 4, and pins 5 coming to rest on the surfaces 15'. Sliding blocks 14 are located in the region of widenings 18 in which the sliding blocks 14 are held with spring resilience, under the effect of the preload of a gasket ring (not shown) inserted between the socket board housing and the multipoint plug housing.

With a longitudinal movement of slider 10 in the opposite direction sliding blocks 14 can be moved out of connecting grooves 15, with a lifting movement of socket contacts 3 away from multipoint contacts 2 automatically taking place when pillow blocks 14 run up against the lower limitation surface 15" of connecting grooves 15. Subsequently, socket board housing 4 can be removed from the multipoint plug housing 1 by guiding pins 5 out of recesses 7.

I claim:

1. A multiterminal electric coupling device comprising:

a longitudinally-extending plug element including a plug housing with grooves on one end thereof and plug contacts contained within said plug housing;

a longitudinally-extending socket element including a socket housing with longitudinally-extending grooves and socket contacts contained within said socket housing;

a hook-pin hinge at one end of said housings for flexibly connecting said plug and socket housings together; and a longitudinally-extending slider having an interior and exterior sides and longitudinally-extending interior-facing strips locatable in said socket housing grooves at an end remote from said hook-pin hinge to allow for guided movement of said slider in the longitudinal direction with respect to said socket element, said slider including blocks rigidly connected to the exterior sides of said slider so that when said blocks slide along the plug housing grooves, said slider moves longitudinally along said socket housing and said housings pivot about said hook-pin hinge whereby said plug housing is joined to said socket housing and said plug contacts are electrically coupled to said socket contacts.

2. The device according to claim 1, wherein said socket housing includes projections and said slider includes catch grooves, so that said slider is releasably locked in place by engagement of said projections within the catch grooves.

3. The device according to claim 1, wherein said plug housing includes two longitudinally-extending walls and a web with adjacent coding slits extending between said walls facing the plug housing grooves, said socket housing having at least one coding projection corresponding to the coding slits.

4. The device according to claim 1, additionally including a sealing element arranged between said housings and surrounding said contacts, wherein the plug housing grooves have an inner widened end, said sealing element elastically loading said socket housing and said slider against said plug housing so that said blocks are elastically fixed at the inner widened end of said plug housing grooves when said housings are connected together.

5. The device according to claim 4, wherein said slider has a U-shaped cross section perpendicular to the longitudinal direction.

6. The device according to claim 5, wherein said U-shaped slider includes two legs having said interior-facing strips formed thereon.

7. The device according to claim 6, wherein said socket element is locatable between said two legs of said slider.

8. The device according to claim 7, wherein said plug housing has a U-shaped cross section perpendicular to the longitudinal direction with two walls facing each other, the plug housing grooves being formed within said two walls.

9. The device according to claim 8, wherein said slider, with said socket element contained therein, is locatable between the two walls of said plug housing with said blocks sliding along the plug housing grooves.

* * * * *